US009238158B2

(12) United States Patent
Strommen

(10) Patent No.: US 9,238,158 B2
(45) Date of Patent: Jan. 19, 2016

(54) STAIR CLIMBER APPARATUSES AND STAIR APPARATUSES

(71) Applicant: Brunswick Corporation, Lake Forest, IL (US)

(72) Inventor: Jon A. Strommen, Ramsey, MN (US)

(73) Assignee: Brunswick Corporation, Lake Forest, IL (US)

( * ) Notice: Subject to any disclaimer, the term of this patent is extended or adjusted under 35 U.S.C. 154(b) by 91 days.

(21) Appl. No.: 14/132,564

(22) Filed: Dec. 18, 2013

(65) Prior Publication Data

US 2015/0190670 A1 Jul. 9, 2015

(51) Int. Cl.
*A63B 22/04* (2006.01)
*B66B 23/12* (2006.01)

(52) U.S. Cl.
CPC ..... *A63B 22/04* (2013.01); *B66B 23/12* (2013.01)

(58) Field of Classification Search
USPC ..... 482/1–148
See application file for complete search history.

(56) References Cited

U.S. PATENT DOCUMENTS

| | | | | |
|---|---|---|---|---|
| 25,076 | A | 8/1859 | Ames | |
| 783,769 | A | 5/1904 | Wright | |
| 3,497,215 | A * | 2/1970 | Harrison et al. | 482/53 |
| 3,592,466 | A * | 7/1971 | Parsons | 482/53 |
| 4,687,195 | A * | 8/1987 | Potts | 482/52 |
| 4,927,136 | A | 5/1990 | Leask | |
| 5,120,050 | A | 6/1992 | Fowell | |
| 5,135,447 | A | 8/1992 | Robards, Jr. et al. | |
| 5,145,475 | A | 9/1992 | Cares | |
| 5,295,928 | A | 3/1994 | Rennex | |
| 5,328,420 | A | 7/1994 | Allen | |
| 5,381,881 | A * | 1/1995 | Meyer et al. | 198/333 |
| 5,556,352 | A * | 9/1996 | Chang | 482/52 |
| 5,769,759 | A | 6/1998 | Alter et al. | |
| 6,855,093 | B2 | 2/2005 | Anderson et al. | |
| 6,905,441 | B2 | 6/2005 | Anderson et al. | |
| 7,052,439 | B2 | 5/2006 | Anderson et al. | |
| 7,204,361 | B2 | 4/2007 | Illedits | |
| 7,387,594 | B1 | 6/2008 | White et al. | |

(Continued)

FOREIGN PATENT DOCUMENTS

| | | |
|---|---|---|
| EP | 0 890 374 | 3/2003 |
| JP | H09240974 | 9/1997 |
| JP | 2012162353 | 8/2012 |

OTHER PUBLICATIONS

International Search Report and Written Opinion, PCT/US2014/071235, date of mailing Apr. 7, 2015.

(Continued)

*Primary Examiner* — Stephen Crow
(74) *Attorney, Agent, or Firm* — Andrus Intellectual Property Law, LLP

(57) ABSTRACT

A stair climber apparatus has a frame and a plurality of stairs that are pivotably connected together in series and travel in a loop with respect to the frame. The plurality of stairs comprises a first stair having a tread and a riser. The tread and riser are pivotably connected together at a first pivot axis. The tread has a tread surface that supports an operator's foot. A stopping member is on the tread. The stopping member has a stop surface that extends transversely to and upwardly from the tread surface and prevents the operator's foot from overshooting the first pivot axis and engaging the riser as the operator steps onto the tread surface when the riser is pivoted away from the tread.

16 Claims, 7 Drawing Sheets

(56) References Cited

U.S. PATENT DOCUMENTS

| | | | | |
|---|---|---|---|---|
| 8,974,353 | B2 * | 3/2015 | Fenster et al. | 482/52 |
| 2007/0170038 | A1 | 7/2007 | Howard et al. | |
| 2011/0177917 | A1 | 7/2011 | Patel | |
| 2012/0238409 | A1 * | 9/2012 | Halsey et al. | 482/52 |
| 2012/0264572 | A1 | 10/2012 | Fenster | |
| 2015/0165263 | A1 * | 6/2015 | Golen et al. | 482/52 |
| 2015/0190671 | A1 * | 7/2015 | Golen et al. | 482/52 |

OTHER PUBLICATIONS

International Search Report and Written Opinion, PCT/US2014/071230, date of mailing Apr. 3, 2015.

International Search Report and Written Opinion, PCT/US2014/071225, date of mailing Mar. 19, 2015.

* cited by examiner

STAIR CLIMBER APPARATUSES AND STAIR APPARATUSES

FIELD

The present disclosure relates to exercise equipment, for example stair climber apparatuses, stair apparatuses, and stair climber systems and methods.

BACKGROUND

U.S. Pat. No. 4,927,136 discloses an electromechanical and more particularly an electromagnetic brake that is utilized in the control of exercise equipment, including escalator-type stair-climbing apparatus in which electronically controllable torque, including a clamping torque, is applied to a rotary shaft to load the exercise equipment, thereby giving complete electronic control to the operation of the exercise apparatus, including a safety locking function.

U.S. Pat. No. 5,120,050 discloses a step-type exerciser that has an endless loop of steps in which each step has an associated pair of pulleys, one at each end, and these run on fixed "inside out" Vee belts. Drive is transmitted by toothed pinion blocks carried adjacent to each roller but angularly fixed whereas the rollers are rotatable, and the blocks engage a second belt which is driven by a motor.

U.S. Pat. No. 5,145,475 discloses an exerciser that provides low impact exercise for the upper and lower body of an operator. The apparatus includes an upper portion having moving rungs simulating a hand-over-hand motion to exercise one's upper body and a lower portion having moving platforms simulating a stair-like climbing motion to exercise one's lower body. The upper and lower portions are oriented at different angles to maximize operator comfort, the angle of the lower portion in particular providing clearance for one's knees during use. The exerciser also includes a variable speed control to adjustable vary the speed of the moving rungs and platforms, thereby adapting to the needs of various operators.

U.S. Pat. No. 5,328,420 discloses a stair step exerciser that is mounted on a frame having horizontal and vertical components. A carriage comprised of a pair of side plates is pivoted to one end of a horizontal component and is retained at the other end in one of a series of vertical stops to selectively determine the angle of the carriage with respect to the frame. The carriage has pulleys at both ends which support the belts on which treads are pivoted at one end. The other end of the treads rest on one rail of a four bar linkage, which linkage expands as the carriage angle is decreased and collapses as the carriage angle is increased so as to always maintain the treads horizontal. A pair of hand cables is provided which move at substantially the same speed as the treads. The hand cables are mounted so as to be closer to the treads as the angle of the carriage increases and so as to move away from the treads as the angle of the carriage decreases.

U.S. Pat. No. 5,556,352 discloses a stair exerciser having a plurality of revolvable steps supported by endless chain conveyors and a control device for speed control, which, by the weight and action of a operator walking on the steps, enables the mechanism to run cyclical and continuous action thereby affording the operator stair climbing like exercises.

U.S. Pat. No. 5,769,759 discloses an apparatus for simulating stair climbing which allows selection of step height. A side member is pivotally mounted to a base and oriented at a selected angle with respect to the base. A displacement mechanism mounted to the base is attached to the side member for rotating the side member with respect to the base. A series of platforms travels in a selected platform path including along the side member. The top surface of each platform is a predetermined horizontal distance from the top surface of an adjacent platform which corresponds to the selected angle.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a stair climber apparatus has a frame and a plurality of stairs that are pivotably connected together in series and travel in a loop with respect to the frame. The plurality of stairs comprises a first stair having a tread and a riser. The tread and riser are pivotably connected together at a first pivot axis. The tread has a tread surface that supports an operator's foot. A stopping member is on the tread. The stopping member has a stop surface that extends transversely to and upwardly from the tread surface and prevents the operator's foot from overshooting the first pivot axis and engaging the riser as the operator steps onto the tread surface when the riser is pivoted away from the tread.

In certain examples, the stop surface is planar and extends perpendicular to the tread surface. The stopping member can be one of a plurality of stopping members that are spaced apart from each other and aligned with respect to the first pivot axis. Each stopping member has a stop surface that extends transversely upwardly from the tread surface. The riser can comprise a plurality of projections that are interdigitated amongst the plurality of stopping members along the first pivot axis. The first pivot axis extends through the plurality of stopping members and the plurality of projections. The plurality of projections can also have stop surfaces that are aligned with the stop surfaces of the plurality of stopping members when the riser is pivoted towards the tread surface. The plurality of projections can be spaced apart so as to define a plurality of recesses in which the plurality of stopping members is disposed.

BRIEF DESCRIPTION OF DRAWINGS

Examples of stair climber apparatuses and related stair apparatuses are described with reference to the following drawing figures. The same numbers are used throughout the figures to reference like features and components.

DETAILED DESCRIPTION OF DRAWINGS

Figure 1:
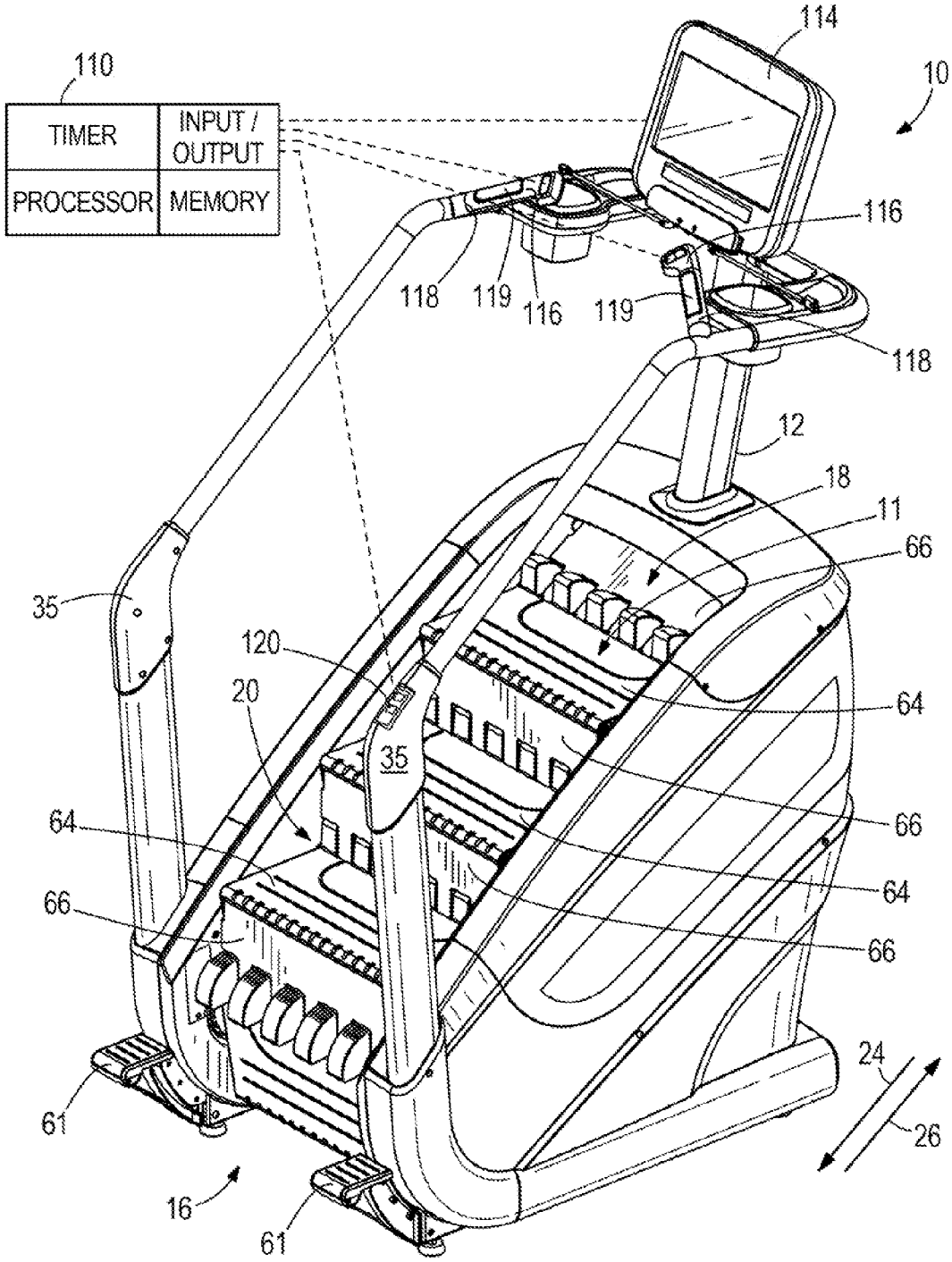
FIG. 1 is a perspective view of a stair climber apparatus.

In the present Description, certain terms have been used for brevity, clearness and understanding. No unnecessary limitations are to be implied therefrom beyond the requirement of the prior art because such terms are used for descriptive purposes only and are intended to be broadly construed. The different stair climber apparatuses, stair apparatuses, systems and methods described herein may be used alone or in combination with other apparatuses, systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

FIGS. 1-4 depict personal exercise equipment, namely a stair climber apparatus 10 having a stair apparatus 11. The stair climber apparatus 10 has a frame 12 that defines an inclined support 14 extending from a lower end portion 16 to an upper end portion 18. A plurality of stairs 20 are connected together in series and travel together in a loop around the inclined support 14. An electric motor 22 is operatively connected to the plurality of stairs 20, as will be described further herein below. The type of electric motor 22 can vary, and in this example includes a conventional asynchronous electric motor, one example of which can be commercially obtained from Eul Ji. During operation, the electric motor 22 can be controlled to rotate an output shaft 28 in a first direction (e.g. forward or clockwise) to move the plurality of stairs 20 in a downward direction 24 with respect to the inclined support 14, and alternately to rotate the output shaft 28 in an opposite, second direction (e.g. reverse or counter-clockwise) to move the plurality of stairs 20 in an upward direction 26 with respect to the inclined support 14, all as will be further described herein below. The electric motor 22 can be operated as a brake to maintain constant speed of movement of the plurality of stairs 20 as an operator steps upwardly on the plurality of stairs 20 (thus providing downward force on the stairs), and/or to slow the speed of movement of the plurality of stairs 20 down to a zero speed, as will be discussed further herein below.

Figure 2:
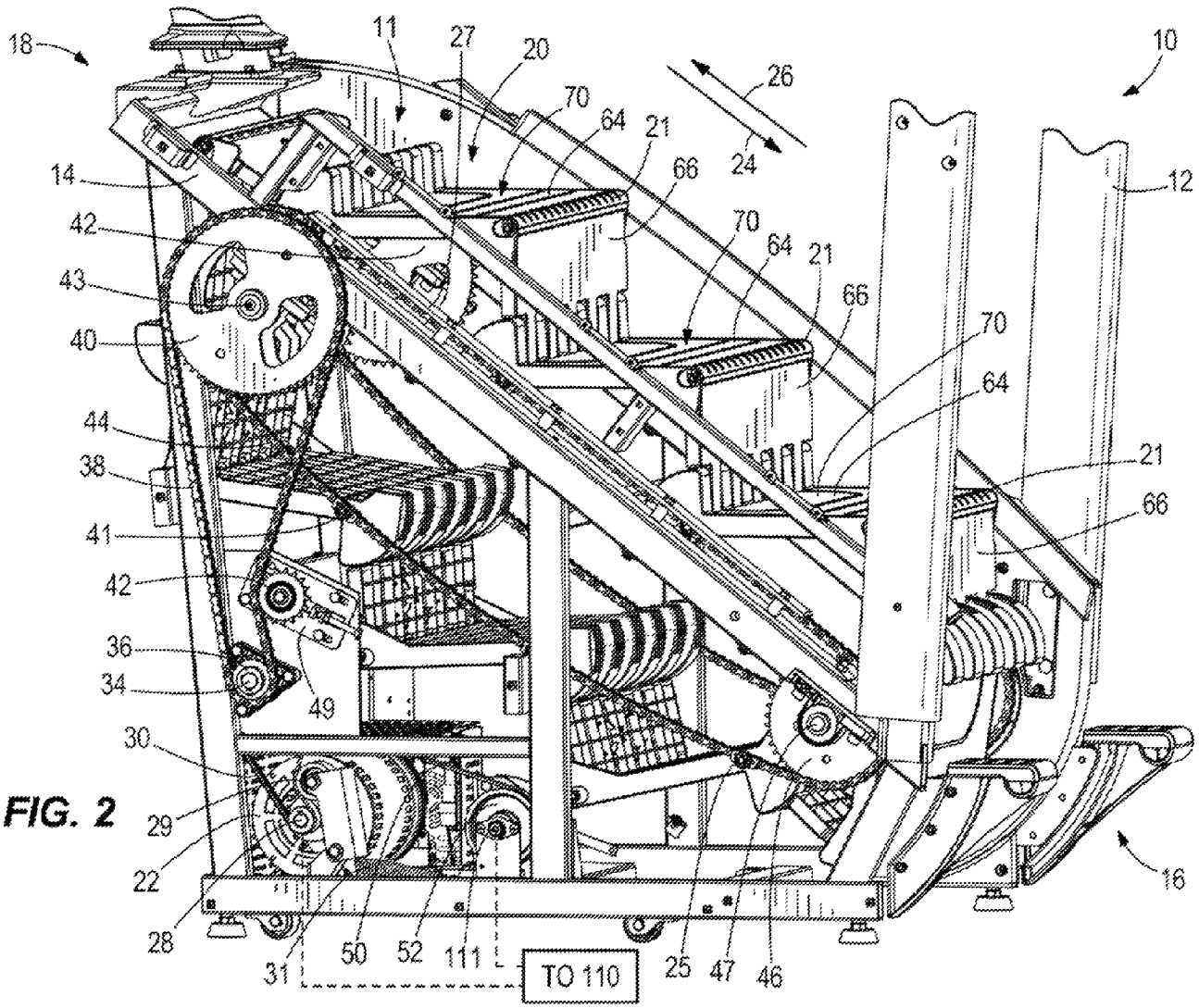
FIG. 2 is a perspective view of the apparatus shown in FIG. 1, having some parts removed for illustration.
Figure 3:
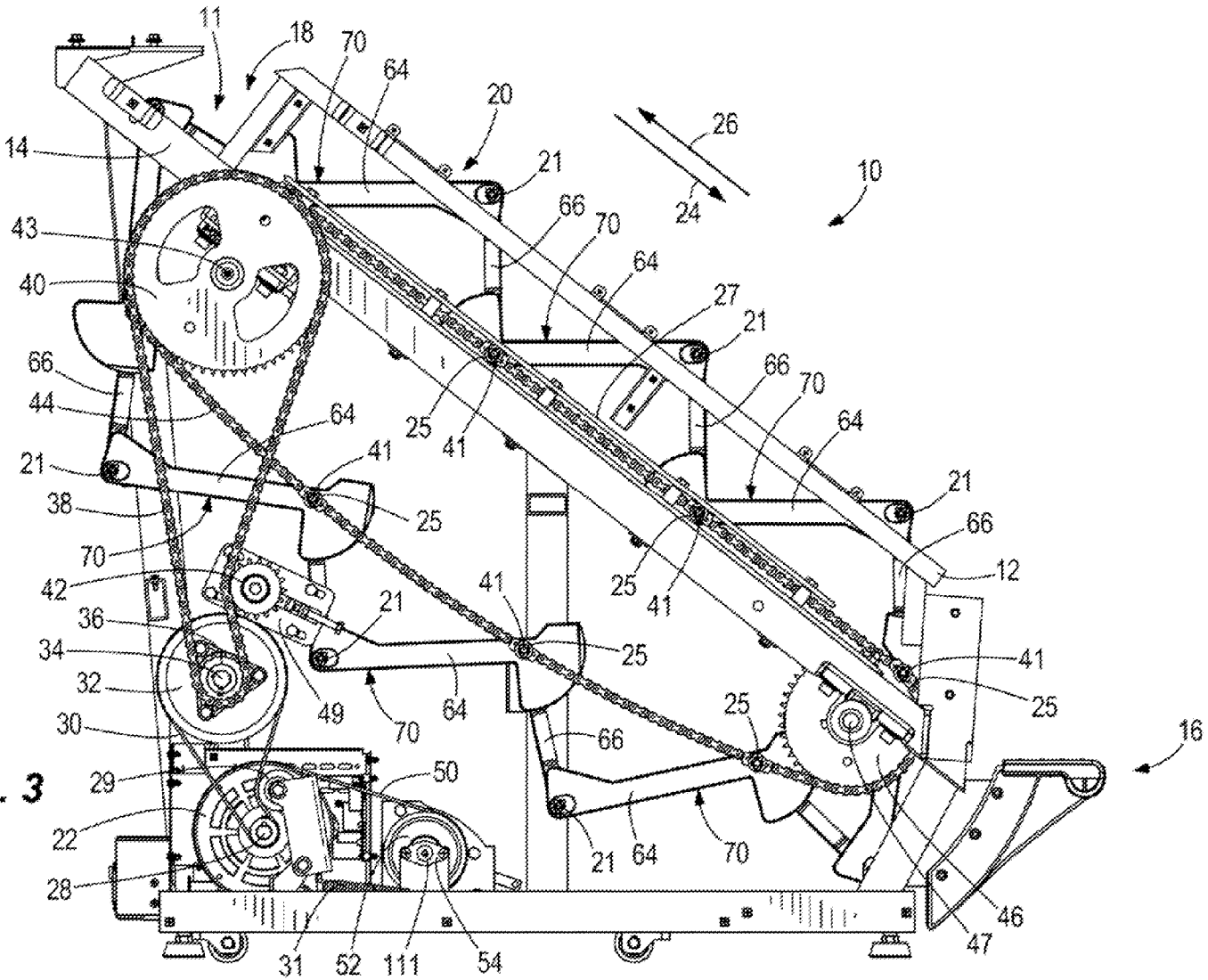
FIG. 3 is a side view of the apparatus shown in FIGS. 2 and 3, having additional parts removed for illustration.
Figure 4:
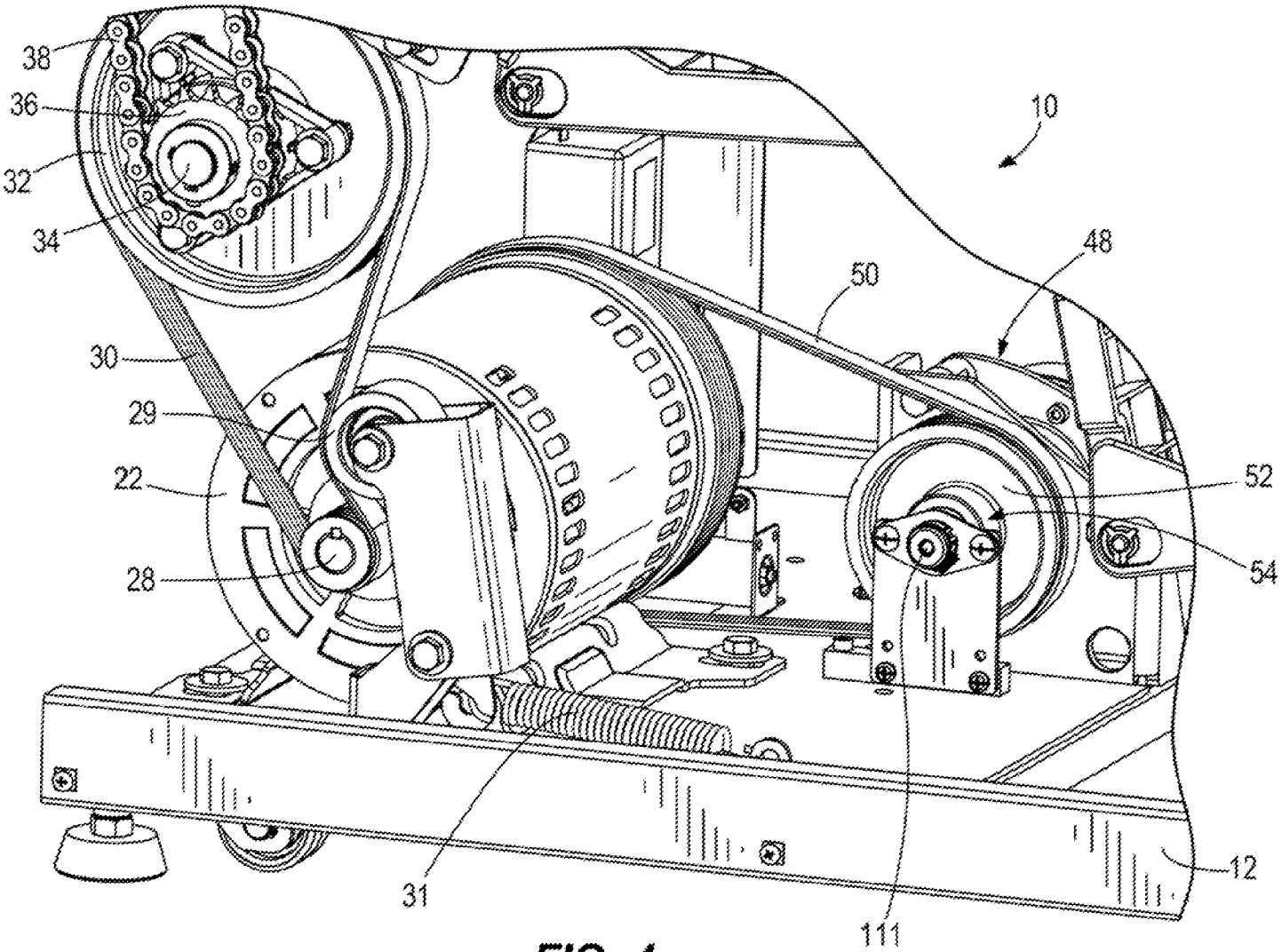
FIG. 4 is a closer view of an electric motor and mechanical brake on the apparatus of FIG. 1.

Referring to FIGS. 2-4, rotation of the output shaft 28 of the electric motor 22 rotates a drive belt 30, which is connected to and rotates a pulley 32 (see FIGS. 3 and 4) about a center live shaft 34. The drive belt 30 is tensioned by a spring 31 that biases an idler roller 29 about a pivot point 33 and against the drive belt 30. Rotation of the pulley 32 about its center live shaft 34 causes corresponding rotation of a lower sprocket 36. Rotation of the lower sprocket 36 causes rotation of a vertically-oriented chain 38 around a loop. The vertically-oriented drive chain 38 rotates around the lower sprocket 36 and an upper sprocket 40. The chain 38 is tensioned by an idler sprocket 49 that abuts against the chain 38 and is laterally adjustable by an adjustment plate 45 that can be fixed at several different positions with respect to the frame 12 to modify the tension. Rotation of the chain 38 causes rotation of the upper sprocket 40 and its center live shaft 43. Rotation of the upper sprocket 40 and the center live shaft 43 causes synchronous rotation of a pair of inner sprockets 42 (only one shown in FIG. 2) that are located on opposite sides of the inclined support 14 and are keyed to the center live shaft 43 for rotation therewith. Rotation of the pair of inner sprockets 42 causes rotation of a pair of drive chains 44 that are located on opposite sides of the inclined support 14. The pair of drive chains 44 angularly extends along the inclined support 14 and is driven in a loop around a lower pair of sprockets 46 and center live shaft 47, which are located at the lower end portion 16 of the inclined support 14.

The drive chains 44 support the plurality of stairs 20 as the stairs 20 travel in the noted loop around the inclined support 14. Each of the stairs 20 has a tread 64 and a riser 66. The tread 64 and the riser 66 are pivotably connected together at a conventional hinge formed by a pivot shaft 21 that extends along a first pivot axis 68 (see FIGS. 5 and 7). The tread 64 has a tread surface 70 that supports an operator's foot 73 (see FIG. 6) as the operator steps onto the stair 20. Each stair 20 in the plurality is connected to an adjacent stair 20 in the plurality by a pivot shaft 41 that extends along a second pivot axis 99 (see FIGS. 5 and 7) that is parallel to the first pivot axis 68. The pivot shaft 21 has opposite ends 23 that carry bearings 25. Each bearing 25 is attached to one of the pair of drive chains 44 and is configured to ride along a bearing support 27 that extends along the inclined support 14 from the lower end portion 16 to the upper end portion 18.

Figure 6:
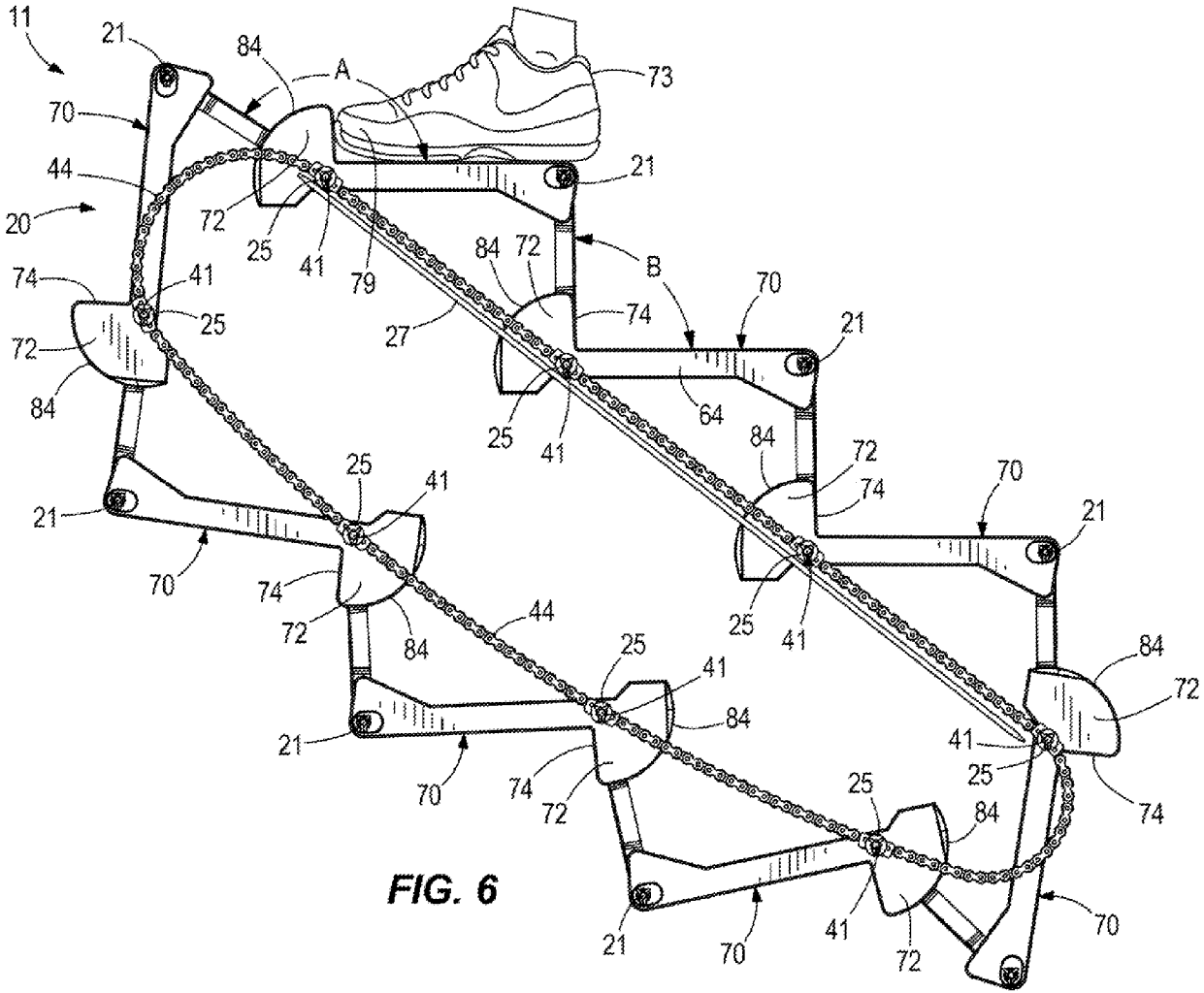
FIG. 6 is a side view of the stair apparatus shown in FIG. 5.

Rotation of the pair of drive chains 44 carries the bearings 25 around the inner sprockets 42 at the upper end portion 18 and around the lower sprockets 46 at the lower end portion 16. As the bearings 25 rotate around the inner sprockets 42 and lower sprockets 46, the bearings 25 are fed into the bearing support 27 and received from the bearing support 27, or vice versa depending upon the direction of operation of the electric motor 22. The stairs 20, via the bearings 25 and the pivot shafts 21, travel with the pair of drive chains 44 around the respective sprockets 42, 46. During said movement, the stairs 20 pivot by gravity with respect to each other along the pivot shafts 41. The tread 64 and riser 66 of each stair 20 also pivot by gravity with respect to each other along the pivot shafts 21. The stairs 20 are configured so that the riser 66 pivots towards the tread 64 up until the bearings 25 begin to ride along the bearing support 27. As the bearings 25 exit the bearing support 27, the tread 64 and riser 66 are configured to pivot away from each other. These pivoting movements of the stairs 20 are shown in FIG. 6.

Referring to FIG. 4, the electric motor 22 is connected to a mechanical brake 48 via a braking belt 50. The type of mechanical brake 48 can be a conventional item and in one example the mechanical brake 48 can include a solenoid actuator that actuates a brake pad to prevent movement of a pulley 52. Actuation of the mechanical brake 48 prevents rotation of a pulley 52 about its center shaft 54, which in turn prevents rotation of the electric motor 22 via the braking belt 50.

The stair climber apparatus 10 also has a control circuit 110 for controlling movement of the stair apparatus 11. The control circuit 110 includes a programmable processor, a memory, a timer, and an input/output device. The processor is communicatively connected to a computer readable medium that includes volatile or nonvolatile memory upon which computer readable code is stored. The processor can access the computer readable code on the computer readable medium, and upon executing the code, can send signals to carry out functions according to the methods described herein below. Execution of the code allows the control circuit 110 to control (e.g. actuate) a series of devices on the stair climber apparatus 10, including but not limited to the electric motor 22. The control circuit 110 may also read values from sensors, and interpret the data using look-up tables or algorithms stored in the memory. Such sensors can include but are not limited to an encoder 111 for detecting and communicating speed and direction of the plurality of stairs 20 to control circuit 110. Such sensors can also include, for example, sensors associated with various operator input devices, which will be further described herein below. The control circuit 110 can be connected to the devices (such as for example the electric motor 22 and various sensors) with which it communicates via conventional wired and/or wireless communication links. It should be noted that the dashed lines shown in FIGS. 1 and 2 are meant to show only that various devices are capable of communicating with the control circuit 110, and do not necessarily represent actual wiring connecting the devices, nor do they represent the only paths of communication between the devices. Further, it should be understood that the control circuit 110 could additionally or alternatively have many separate and/or communicatively interconnected control circuits or control units/sections at various locations on the stair climber apparatus 10.

As mentioned above, several operator input devices are provided on the stair climber apparatus 10 for communicating operator commands to the control circuit 110. The operator input devices can include, for example one or more conventional video/touch control panels 114 and/or one or more conventional speed control push buttons 116 located on handle members 118. The video/touch control panels 114 and/or buttons 116 can communicate operator inputs to the control circuit 110 for operating the stair climber apparatus 10 according to one or more predetermined exercise programs having certain time periods and providing certain resistance characteristics. Additional the operator input devices can include, for example heart rate monitors 119 located on the handle members 118 for communicating heart rate of the operator for communication to the control circuit 110. The operator input devices are not limited to these types of devices and can also or alternatively include devices for providing output devices such as visual, audial, tactile, and/or other sensory feedback to the operator. The operator inputs to the control circuit 110 via the operator input devices are acted upon by the control circuit 110 to control operation of the stair climber apparatus 10 according to various programs, which include programs for affecting the speed and direction of movement of the plurality of stairs 20 via the electric motor 22. Thus, when the operator is located on the stair climber apparatus 10, the operator can input, via the various input devices, speed commands to the control circuit 110 for controlling speed of movement and direction of movement of the plurality of stairs 20, as will be understood by those having ordinary skill in the art. A operator boarding (i.e. second) operator input device 120 is also located at the lower end portion 16 of the inclined support 14 and will be described further herein below.

During operation, as the operator steps forwardly (i.e. in the upward direction 26) along the inclined support 14, the electric motor 22 rotates the output shaft 28 to move the plurality of stairs 20 in the downward direction 26 with respect to the inclined support 14. A specific speed of movement of the plurality of stairs 20 can be selected (i.e. set) by the operator via one of the noted input devices. Based upon this input, the control circuit 110 is programmed to control the output torque and speed of the electric motor 22 to maintain the speed of movement of the plurality of stairs at a constant speed selected by the operator, despite physical characteristics of the operator and/or the changes in stepping speed of the operator. The speed of the stairs 20 and direction of movement of the stairs 20 is sensed and communicated to the control circuit 110 via the encoder 111, as is conventional. Based upon this information, the control circuit 110 adjusts the power (e.g. current) to the electric motor 22 to thereby affect the speed of the electric motor 22. Power can be supplied to the electric motor 22 via a conventional power cord, and/or one or more batteries, and/or the like.

Figure 5:
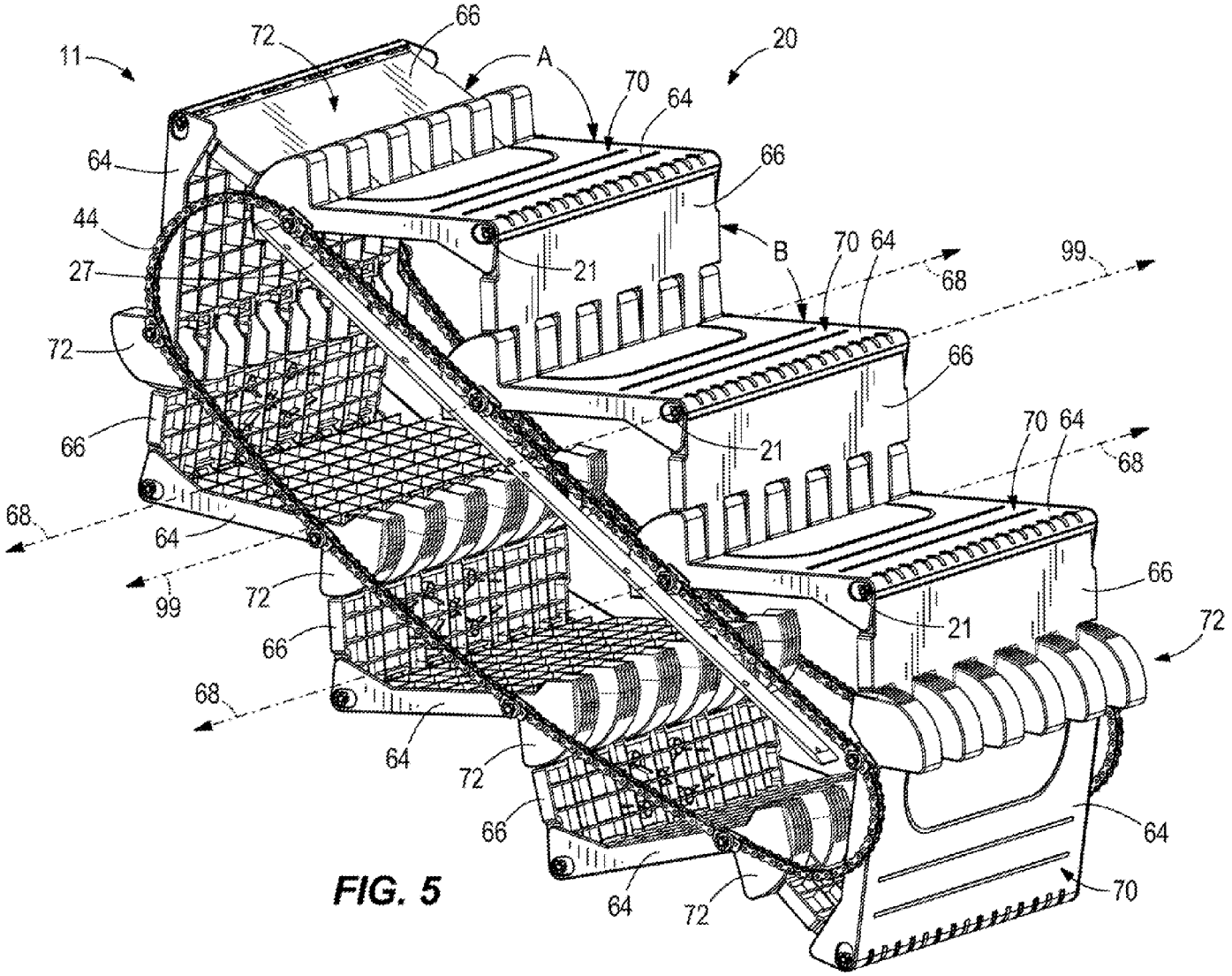
FIG. 5 is a view of a stair apparatus that comprises a plurality of stairs that are pivotably connected together in series and travel in a loop.
Figure 7:
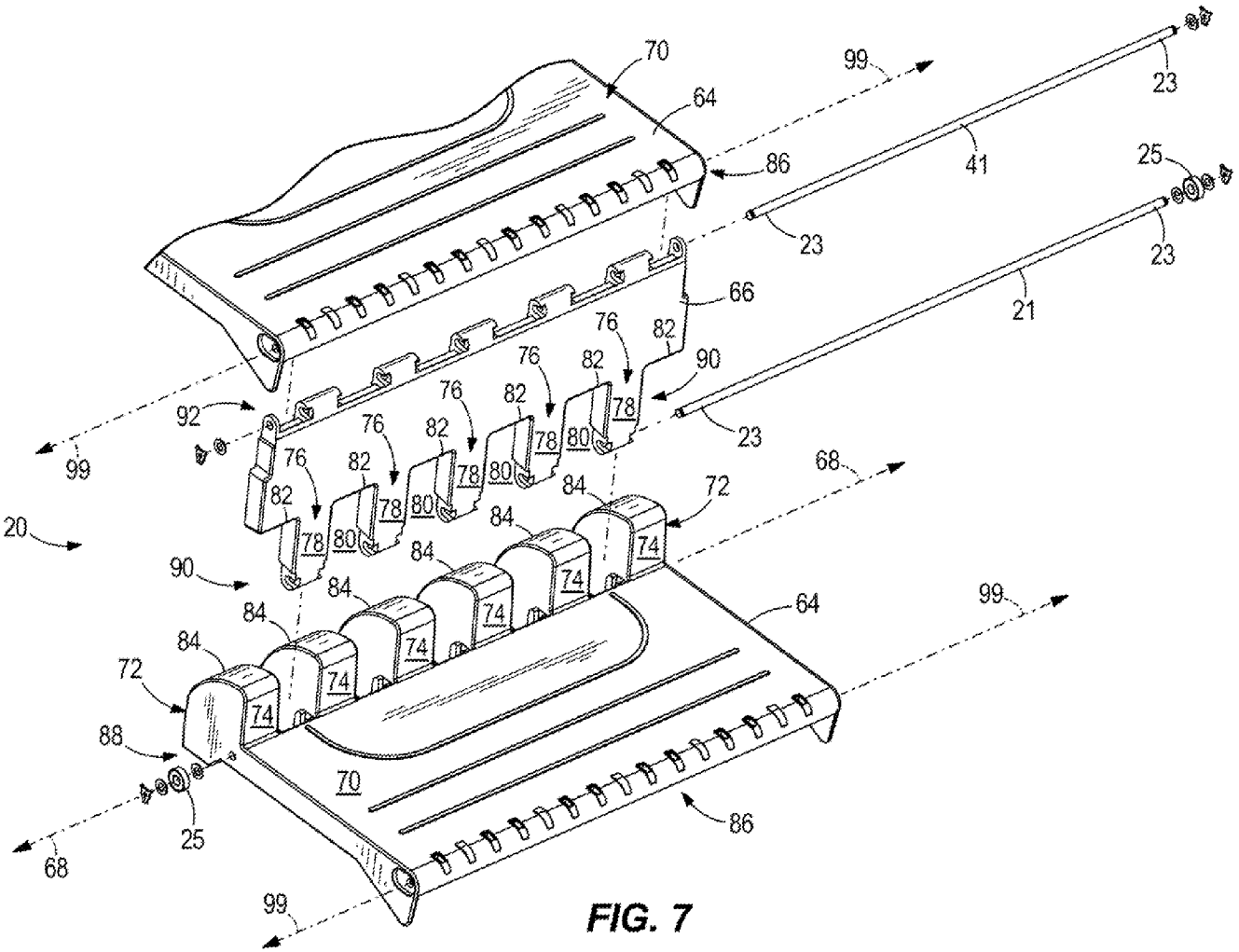
FIG. 7 is an exploded view of a stair apparatus shown in FIG. 5.

Referring to FIGS. 5-7, through research and development, the present inventor has recognized that as each stair 20 travels around the upper sprocket 40 and into the downward direction 24, the riser 66 pivots from an angle A with respect to the tread 64 to a lesser angle B with respect to the tread 64. Through research, it has been found that operators often step onto the uppermost tread surface 70 on the inclined support 14 at the same time as when the riser 66 is pivoting towards the tread surface 70. In such situations, if the operator oversteps the first pivot axis 68 (i.e. the operator's toe 79 oversteps the tread surface), the operator's toe 79 can be impinged upon or pinched by the riser 66 as it pivots into the angle B. This can undesirably result in discomfort and/or injury to the operator.

To prevent such an occurrence, one or a plurality of stopping members 72 is disposed on the tread 64 of each of the stairs 20 in the plurality of stairs 20. Referring to one of the stairs (i.e. a first stair) in FIG. 7, each stopping member 72 has a stop surface 74 that extends transversely upwardly from the tread surface 70. The stop surface 74 is configured to block and thereby prevent the operator's foot 73 from overshooting the first pivot axis 68 and engaging the riser 66 as the operator steps onto the tread surface 70 when the riser 66 is pivoted out of the perpendicular angle B (see FIG. 6) with respect to the tread 64 and more particularly with respect to the tread surface 70. This feature prevents the operator's toe 79 and/or other body part from becoming impinged or pinched by the tread 64 as the tread 64 pivots from the angle shown at A in FIGS. 5 and 6 towards the angle shown at B in FIGS. 5 and 6.

The particular physical configuration of the stopping members 72 and associated stop surfaces 74 can vary from that which is shown. In this example, the stop surface 74 is planar and extends perpendicular to the tread surface 70. Each stopping member 72 in the plurality is spaced apart from the other stopping members 72 in the plurality, and the plurality of stopping members 72 are aligned with respect to the first pivot axis 68. The stop surface 74 extends transversely to and upwardly from the tread surface 70.

Referring to FIG. 7, the riser 66 has a plurality of projections 76 that are interdigitated amongst the plurality of stopping members 72 along the first pivot axis 68. The first pivot axis 68 and pivot shaft 21 extend through the plurality of stopping members 72 and the plurality of projections 76. The plurality of projections 76 also each have stop surfaces 78 that are aligned with the stop surfaces 74 of the plurality of stopping members 72 when the riser 66 is positioned at the noted angle B to the tread surface 70. The plurality of stop surfaces 78 of the plurality of projections 76 is planar. The plurality of projections 76 are spaced apart along the first pivot axis 68 so as to define a plurality of recesses 80 in which the plurality of stopping members 72 are disposed. Each recess 80 has a top edge 82 and each stopping member 72 has a curved back surface 84 alongside of which the top edge 82 travels as the riser 66 is pivoted with respect to the tread 64.

Each tread 64 includes a front edge 86 and a back edge 88. Each riser 66 includes a front edge 90 and a back edge 92. The back edge 88 of the tread 64 is pivotably connected to the front edge 90 of the riser 66 at the noted first pivot axis 68. In this manner, the plurality of stopping members 72 prevent any portion of the operator's foot 73 from overshooting the back edge 88 of the tread 64 as the operator steps onto the tread surface 70 when the riser 66 is pivoted out of the angle B with respect to the tread 64.

Referring to FIG. 6, each adjacent stair 20 in the plurality also has the tread 64 and the riser 66. The tread 64 of an adjacent (e.g. second) stair 20 is pivotably connected to the tread 64 of the noted first stair 20 at the second pivot axis 99, which is parallel to the first pivot axis 68. The tread 64 and riser 66 of the adjacent stair 20 are pivotably connected together along a first pivot axis 68 that is parallel to the second pivot axis 99. Like the first stair 20, the adjacent stair 20 has a stopping member 72 having a stop surface 74 that extends transversely upwardly from a tread surface 70 of the adjacent stair 20 so as to prevent the operator's foot 73 from overshooting the second pivot axis 99 and engaging the riser 66 as the operator steps on the tread surface 70 of the adjacent stair 20 when the riser 66 is pivoted away from the tread 64 of the adjacent stair 20. The remaining stairs 20 in the plurality are similarly configured.

This disclosure thus provides a plurality of stairs 20 that travel in the noted loop around the inclined support 14 in such a manner that when the operator's foot 73 steps on the stair at the upper end portion 18 of the inclined support 14, the operator's toe 79 or any portion of the operator's body will not be impinged upon or pinched by the riser 66 as the riser 66 pivots around the center live shaft 43 and moves from the angle A to the angle B with respect to the tread 64. More specifically, the operator's toe 79 will be blocked from overshooting the first pivot axis 68 about which the riser 66 pivots, thereby protecting the operator's toe 79 and/or other body parts from becoming impinged upon or pinched.

What is claimed is:

1. A stair climber apparatus comprising:

a frame;

a plurality of stairs that are pivotably connected together in series and travel in a loop with respect to the frame, the plurality of stairs comprising a first stair having a tread and a riser, wherein the tread and riser are pivotably connected together at a first pivot axis, and wherein the tread has a tread surface that supports an operator's foot; and a stopping member on the tread, the stopping member having a stop surface that extends transversely to and upwardly from the tread surface and prevents a portion of the operator's foot from overshooting the first pivot axis and engaging the riser as the operator steps onto the tread surface when the riser is pivoted away from the tread;

wherein the stopping member is one of a plurality of stopping members that are spaced apart from each other and aligned with respect to the first pivot axis; wherein each stopping member has a stop surface that extends transversely upwardly from the tread surface; and wherein the riser comprises a plurality of projections that are interdigitated amongst the plurality of stopping members along the first pivot axis.

2. The stair climber apparatus according to claim 1, wherein the first pivot axis extends through the plurality of stopping members and the plurality of projections.

3. The stair climber apparatus according to claim 2, wherein the plurality of projections have stop surfaces that are aligned with the stop surfaces of the plurality of stopping members when the riser is positioned at the perpendicular angle to the tread surface.

4. The stair climber apparatus according to claim 3, wherein the plurality of stop surfaces of the plurality of stopping members is planar; and wherein the plurality of stop surfaces of the plurality of projections is planar.

5. The stair climber apparatus according to claim 1, wherein the plurality of projections are spaced apart so as to define a plurality of recesses in which the plurality of stopping members is disposed.

6. The stair climber apparatus according to claim 5, wherein each recess in the plurality of recesses has a top edge and wherein each stopping member in the plurality of stopping members comprises a curved back surface along which the top edge travels as the riser is pivoted with respect to the tread.

7. A stair climber apparatus comprising:

a frame;

a plurality of stairs that are pivotably connected together in series and travel in a loop with respect to the frame, the plurality of stairs comprising a first stair having a tread and a riser, wherein the tread and riser are pivotably connected together at a first pivot axis, and wherein the tread has a tread surface that supports an operator's foot; and a stopping member on the tread, the stopping member having a stop surface that extends transversely to and upwardly from the tread surface and prevents a portion of the operator's foot from overshooting the first pivot axis and engaging the riser as the operator steps onto the tread surface when the riser is pivoted away from the tread;

wherein the tread comprises a front edge and a back edge and wherein the riser comprises a front edge and a back edge; and wherein the back edge of the tread is pivotably connected to the front edge of the riser at the first pivot axis; and wherein the stopping member prevents the operator's foot from overshooting the back edge of the tread as the operator steps onto the tread surface when the riser is pivoted away from the tread.

8. The stair climber apparatus according to claim 7, wherein the stop surface is planar.

9. The stair climber apparatus according to claim 7, wherein the stop surface extends perpendicular to the tread surface.

10. The stair climber apparatus according to claim 7, comprising a second stair having a tread and a riser, wherein the tread of the second stair is pivotably connected to the riser of the first stair at a second pivot axis that is parallel to the first pivot axis.

11. The stair climber apparatus according to claim 10, wherein the tread and riser of the second stair are pivotably connected together along pivot axis that is parallel to the first and second pivot axes.

12. The stair climber apparatus according to claim 11, comprising a stopping member on the tread of the second stair, the stopping member having a stop surface that extends transversely upwardly from a tread surface of the second stair so as to prevent the operator's foot from overshooting the pivot axis that is parallel to the first and second pivot axes and engaging the riser of the second stair as the operator steps onto the tread surface of the second stair when the riser of the second stair is pivoted away from the tread of the second stair.

13. A stair apparatus comprising: a plurality of stairs that are pivotally connected together in series so as to form a loop, the plurality of stairs comprising a first stair having a tread that is pivotably connected to a riser at a first pivot axis, the tread having a tread surface that supports an operator's foot; and a stopping member on the tread surface, the stopping member having a stop surface that extends transversely to and upwardly from the tread surface and prevents the operator's foot from overshooting the first pivot axis and engaging the riser as the operator steps onto the tread surface when the riser is pivoted away from the tread;

wherein the stopping member is one of a plurality of stopping members that are spaced apart from each other and aligned with respect to the first pivot axis; wherein each stopping member has a stop surface that extends transversely upwardly from the tread surface;

wherein the riser comprises a plurality of projections that are interdigitated amongst the plurality of stopping members along the first pivot axis;

wherein the first pivot axis extends through the plurality of stopping members and the plurality of projections;

wherein the plurality of projections have stop surfaces that are aligned with the stop surfaces of the plurality of stopping members when the riser is positioned at the perpendicular angle to the tread surface;

wherein the plurality of stop surfaces of the plurality of stopping members are planar; and wherein the plurality of stop surfaces of the plurality of projections are planar.

14. The stair apparatus according to 13, wherein the stop surface extends perpendicularly to the tread surface.

15. The stair apparatus according to 13, wherein the stop surface is planar.

16. The stair apparatus according to claim 13, wherein the plurality of projections are spaced apart so as to define a plurality of recesses in which the plurality of stopping members are disposed; and wherein each recess in the plurality of recesses has a top edge and wherein each stopping member in the plurality of stopping members comprises a curved back surface along which the top edge travels as the riser is pivoted with respect to the tread.

* * * * *